US008591328B2

(12) United States Patent
Rasmussen

(10) Patent No.: US 8,591,328 B2
(45) Date of Patent: Nov. 26, 2013

(54) MECHANICAL-BASED CONTROL OF VIDEO REELS IN A GAME MACHINE

(75) Inventor: James M. Rasmussen, Chicago, IL (US)

(73) Assignee: WMS Gaming Inc., Chicago, IL (US)

( * ) Notice: Subject to any disclaimer, the term of this patent is extended or adjusted under 35 U.S.C. 154(b) by 1071 days.

(21) Appl. No.: 12/480,202

(22) Filed: Jun. 8, 2009

(65) Prior Publication Data

US 2009/0305767 A1 Dec. 10, 2009

Related U.S. Application Data

(60) Provisional application No. 61/059,955, filed on Jun. 9, 2008.

(51) Int. Cl.
*A63F 1/00* (2006.01)

(52) U.S. Cl.
USPC ..... 463/31; 463/16; 463/17; 463/18; 463/19; 463/20; 463/33; 463/43

(58) Field of Classification Search
USPC ..... 463/12–13, 16–22, 25, 29, 30–34, 463/40–43
See application file for complete search history.

(56) References Cited

U.S. PATENT DOCUMENTS

| | | | | |
|---|---|---|---|---|
| 6,227,970 | B1 | 5/2001 | Shimizu et al. | |
| 6,251,014 | B1 | 6/2001 | Stockdale et al. | |
| 6,863,608 | B1 | 3/2005 | LeMay et al. | |
| 7,108,605 | B2 * | 9/2006 | LeMay et al. | 463/43 |
| 2004/0102241 | A1 * | 5/2004 | Kaminkow | 463/20 |
| 2006/0009286 | A1 | 1/2006 | Durham et al. | |

FOREIGN PATENT DOCUMENTS

WO WO-2008021181 A2 2/2008

* cited by examiner

*Primary Examiner* — Sunit Pandya
(74) *Attorney, Agent, or Firm* — Schwegman Lundberg & Woessner, P.A.

(57) ABSTRACT

In some example embodiments, a method includes executing a wagering game that generates instructions for control of a number of mechanical reels. The method also includes converting the instructions for controlling the number of mechanical reels into identifiers of video sequences stored in machine-readable media. The video sequences comprising a display representative of a stop result of the mechanical reels. The method includes retrieving the video sequences from the machine-readable media. The method includes displaying the video sequences on displays for video reels of a wagering game machine.

25 Claims, 8 Drawing Sheets

MECHANICAL-BASED CONTROL OF VIDEO REELS IN A GAME MACHINE

RELATED APPLICATION

This patent application claims the priority benefit of U.S. Provisional Application Ser. No. 61/059,955 filed Jun. 9, 2008 and entitled "MECHANICAL-BASED CONTROL OF VIDEO REELS IN A GAME MACHINE", the content of which is incorporated herein by reference in its entirety.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2008, WMS Gaming, Inc.

BACKGROUND

Game machines including wagering game machines such as slot machines, video poker machines and the like, have been a part of the gaming industry for several years. Game machines can include different types and number of reels for displaying the result of a game.

BRIEF DESCRIPTION OF THE FIGURES

Embodiments of the invention are illustrated by way of example and not limitation in the Figures of the accompanying drawings in which.

DESCRIPTION OF THE EMBODIMENTS

Figure 1:
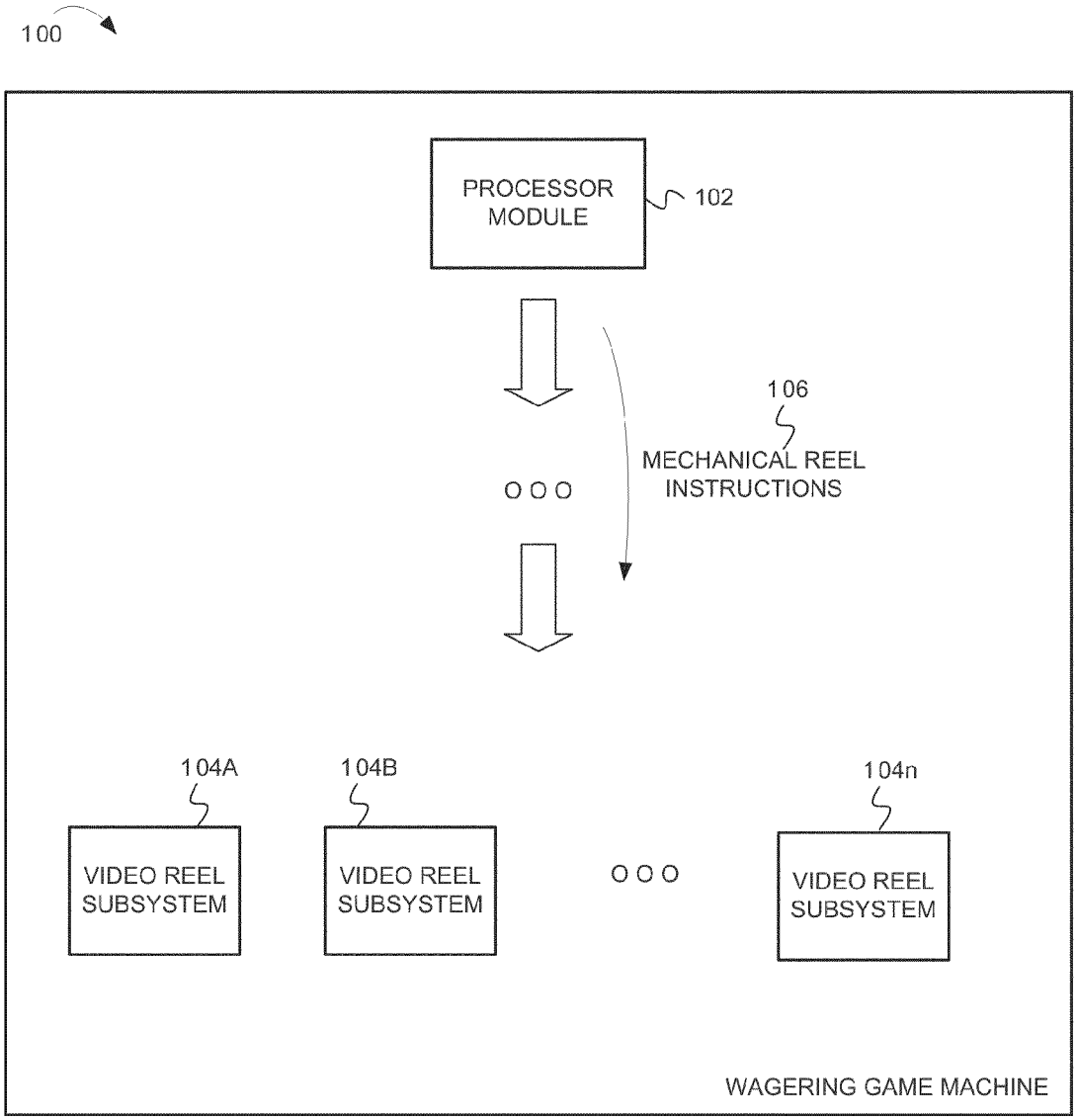
FIG. 1 is a block diagram illustrating an architecture for controlling video reels in a wagering game machine, according to some example embodiments.

This description is divided into six sections. The first section includes an introduction to some example embodiments, whereas the second section describes an example operating environment. The third section presents example operations, and the fourth section describes an example wagering game network. The fifth section describes example wagering game machines, and the sixth section provides some general comments.

Introduction

In some example embodiments, methods, apparatus and systems provide for the control of video reels in a game machine that display the result of a game application being executed. While described relative to a wagering game machine, some example embodiments may be executed in any type of game machine that includes video reels (e.g., pachinko game devices, Award With Prize machines, etc.).

In some wagering game machines, video reels are replacing mechanical reels to display various results of the execution of a game application. Some conventional wagering game machines that have video reels include one projection device along with a multitude of projection screens for the reel viewing windows. This projection device typically uses a dedicated video output on the main processor module within the wagering game machine. Moreover, some wagering game machines are being configured such that more components are using the video outputs from the main processor module. For example, a panel (e.g., a transmissive LCD panel, such as described in U.S. patent application Ser. No. 11/576,126, titled "Transmissive LCD Display System for Gaming Machine" to James M. Rasmussen and Alfred Thomas" filed Mar. 27, 2007) is being added to some wagering game machines to enable updates to the theme-based art therein. Moreover, this panel may be used to reproduce the win/bet/credit meter functionality. Furthermore, some wagering game machines may include a display on a top box glass for updates to the theme, bonus screen, pay table, etc. and a different display for a variable belly glass functionality. These different displays in the wagering game machines may require the use of dedicated video outputs from the main processor module. However, in some wagering game machines, the number of video outputs may be limited because of costs, architectural limitations, etc.

Some example embodiments include a wagering game machine with video reels that do not require the use of a video output port. Moreover, some example embodiments can use existing game applications that provide control for mechanical reels for operating within a wagering game machine that includes video reels. In particular, some example embodiments enable the control of one or more video reels in a wagering game machine based on mechanical reel instructions that are generated as a result of executing a wagering game. Accordingly, the developers of wagering games may only be required to generate one set of instructions for controlling the reels of the machine. These instructions may then be used for controlling different types of reels (mechanical, video, etc.).

Moreover, some example embodiments may be used in a server-based game network. In contrast to mechanical reel-based wagering game machines, such a network enables updates to video reels within the wagering game machines coupled to the network. In some example embodiments, different types of video reels may be used for different game applications. For example, the video reels may comprise different symbols, different bonus modes, different colors, lighting, etc. Because of the architecture for controlling the video reels (as further described below), updates to the video reels may occur to one or more such reels.

Example Operating Environment

Example Wagering Game Machine Architecture

FIG. 1 is a block diagram illustrating an architecture for controlling video reels in a wagering game machine, according to some example embodiments. As shown in FIG. 1, the wagering game machine 100 includes a processor module 102 that is coupled to a number of video reel subsystems 104A-104*n*. In some example embodiments, the processor module 102 may execute a wagering game application which can present wagering games, such as video poker, video black jack, video slots, video lottery, etc., in whole or part.

In some example embodiments, the processor module 102 is coupled to the video reel subsystems 104 independent of a video output port. In some example embodiments, the processor module 102 is coupled to the video reel subsystems 104 using different types of communication links (e.g., serial, parallel, etc.). For example, the processor module 102 may be coupled to the video reel subsystems 104 through a Universal Serial Bus link.

In some example embodiments, the processor module 102 outputs one or more mechanical reel instructions 106 as a result of execution of the wagering game application. The mechanical reel instructions 106 may be transmitted to one or more of the video reel subsystems 104. In some example embodiments, there is a one-to-one relationship between a mechanical reel and a video reel. Accordingly, the output from the wagering game application may include instructions for five mechanical reels. Accordingly, the wagering game machine 100 would include five video reels (that include a display on which the video reel subsystems display video sequences). For a given mechanical reel, the mechanical reel instructions 106 may comprise an instruction to spin for a time period, locate a home position on the mechanical reel, proceed N number of motor steps and then stop. As further described below, the video reel subsystems 104 may convert these instructions into a video sequence that includes a stop result. For example, the video sequence may include a seven symbol in the middle with a single bar symbol above and a cherry symbol below. In some example embodiments, the video reel subsystem 104 may store a video sequence for each possible reel outcome. For example, for a mechanical reel with 22 symbols, there may be 22 possible reel outcomes. In some example embodiments, there may be multiple video sequences for a given reel outcome. For example, a first video sequence may include a given symbol result with no lights flashing. A second video sequence may include the same symbol result with lights flashing behind the middle symbol. A third video sequence may include the same symbol result with simulated lights flashing behind the symbol above, etc. A more detailed description of the conversion to a video sequence is set forth below.

Figure 2:
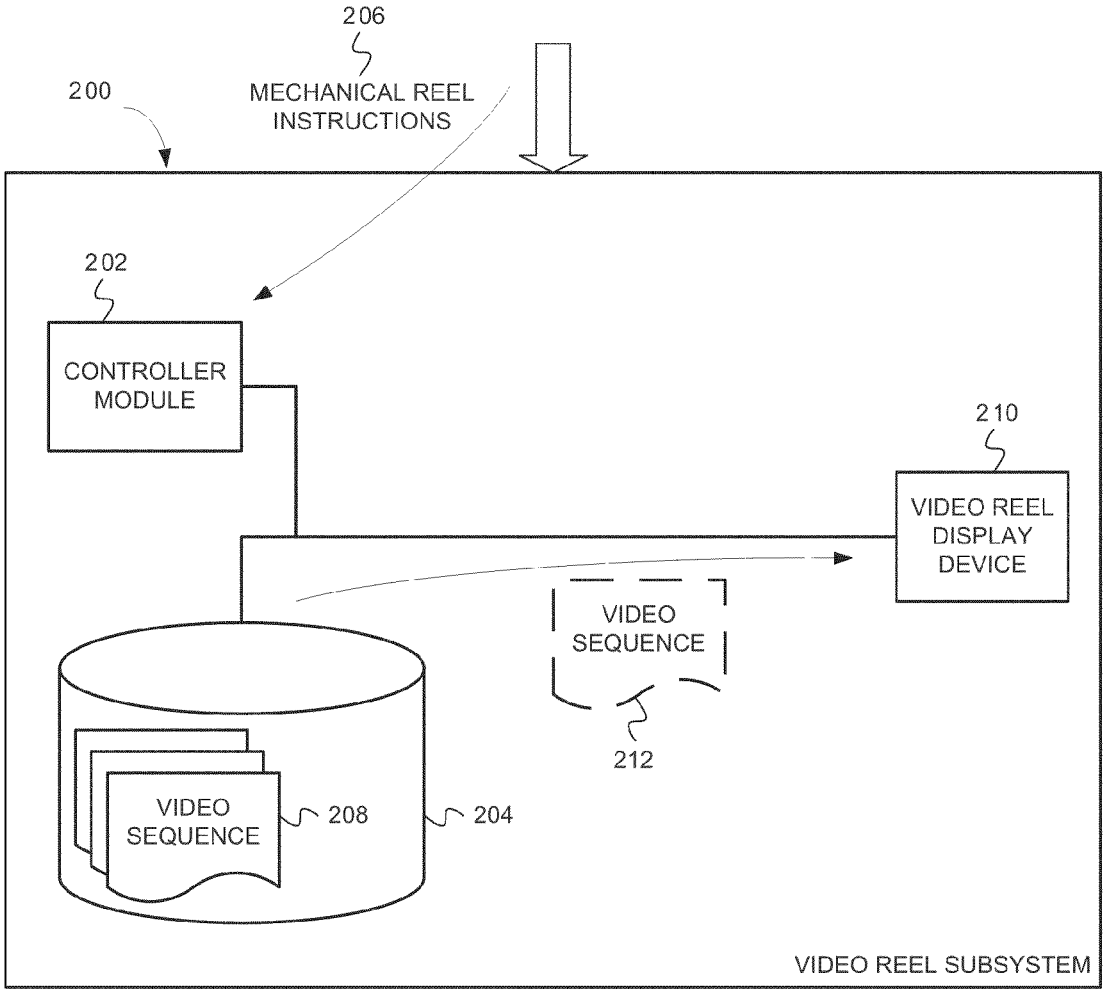
FIG. 2 is a block diagram illustrating a video reel subsystem, according to some example embodiments.

A more detailed block diagram of one of the video reel subsystems 104 is now described. In particular, FIG. 2 is a block diagram illustrating a video reel subsystem, according to some example embodiments. As shown in FIG. 2, the video reel subsystem 200 includes a controller module 202, a machine-readable medium 204 and a video reel display device 210.

The machine-readable medium 204 may be any type of tangible machine-readable medium. For example, the machine-readable medium 204 may be read only memory (ROM), random access memory (RAM), magnetic disk storage media, optical storage media, flash memory machines, etc. The machine-readable medium 204 stores a number of video sequences 208. In some example embodiments, a video sequence includes display of a stop result of a reel on a wagering game machine. For example, the video sequence may be a triple bar symbol in the middle, a seven symbol above and a cherry symbol below. Moreover, one or more video sequences may include a display of a spinning reel.

In some example embodiments, the controller module 202 controls the display of video on a given video reel on a wagering game machine. The controller module 202 receives mechanical reel instructions 206 (from the processor module (not shown) as described above). The controller module 202 converts the mechanical reel instructions 206 to an address (or any other type of identifier) where a video sequence 208 is stored in the machine-readable medium 204. As described above, the instructions may comprise instructions for spinning for a time period, locating a home position on the mechanical reel, proceed N number of motor steps and then stop.

The controller module 202 may retrieve a video sequence of a spinning reel from the machine-readable medium 204. The controller module 202 may cause the video reel display device 210 to display this video sequence for the time period defined in the mechanical reel instructions. Furthermore, the controller module 202 may retrieve a video sequence that corresponds to a stop result for the mechanical reel instructions. In some example embodiments, the controller module 202 determines the address of a video sequence based on the home position and number of motor steps from this home position prior to stopping the mechanical reel. For example, the home position may be a cherry symbol on the mechanical reel. The number of motor steps in the mechanical reel instruction then determines which particular symbol configuration would be displayed on the mechanical reel. For example, if the number of motor steps from the home position equals five, a double bar symbol would be displayed in the middle, a seven symbol below and a cherry symbol above. Therefore, the controller module 202 may retrieve the video sequence 208 that would display this particular symbol configuration.

In some example embodiments, the machine-readable medium 204 stores a video sequence for each possible reel outcome. For example, for a mechanical reel with 22 symbols, there may be 22 possible reel outcomes. As described above, in some example embodiments, there may be multiple video sequences for a given reel outcome. Therefore, if there were three different video sequences for each of the 22 possible reel outcomes, the machine-readable medium 204 would store 66 different possible reel outcomes. Thus, in some example embodiments, mechanical reel instructions that include a home position plus X number of motor steps would be converted to an address of video sequence A; mechanical reel instructions that include a home position plus Y number of motor steps would be converted to an address of video sequence B, etc. Therefore, the controller module 202 may cause the video reel display device 210 to display the video sequence that displays the stop result of the reel defined in the mechanical reel instructions 206. The mechanical reel instructions 206 may also include instructions to further highlight the stop result. For example, the mechanical reel instructions may include an instruction to flash a light behind the middle symbol. Therefore, the controller module 202 retrieves a video sequence that includes the particular symbol configuration that includes flashing behind the middle symbol.

In some example embodiments, the machine-readable medium 204 may store some type of data structure (e.g., table, list, etc.) for converting the mechanical reel instructions to the video sequences. For example, five motor steps from the home position with no highlighting would correspond to the address of video sequence X; five motor steps from the home position with highlighting the upper symbol would correspond to the address of video sequence Y; six motor steps from the home position with no highlighting would correspond to the address of video sequence Z; etc.

As shown in FIG. 2, a video sequence 212 is retrieved from the machine-readable medium 204 for display on the video reel by the video reel display device 210. The video reel display device 210 may be any type of display device (e.g., rear projector, liquid crystal display (LCD), plasma, organic light-emitting diode (OLED) display, etc.)

In some example embodiments, the video sequences 208 may be stored in the machine-readable medium 204 prior to deployment of the wagering game machine. Alternatively or in addition, the video sequences 208 may be downloaded from a component (e.g., a game server) coupled to a network to which the wagering game machine is coupled (see description of FIG. 7 below). Alternatively or in addition, the video sequences 208 may be updated through any type of input/output port of the wagering game machine (a Universal Serial Bus port, a Firewire port, etc.). For example, an operator of the wagering game machine may update the video sequences using a FLASH storage device that is coupled into a USB port of the wagering game machine.

Figure 3:
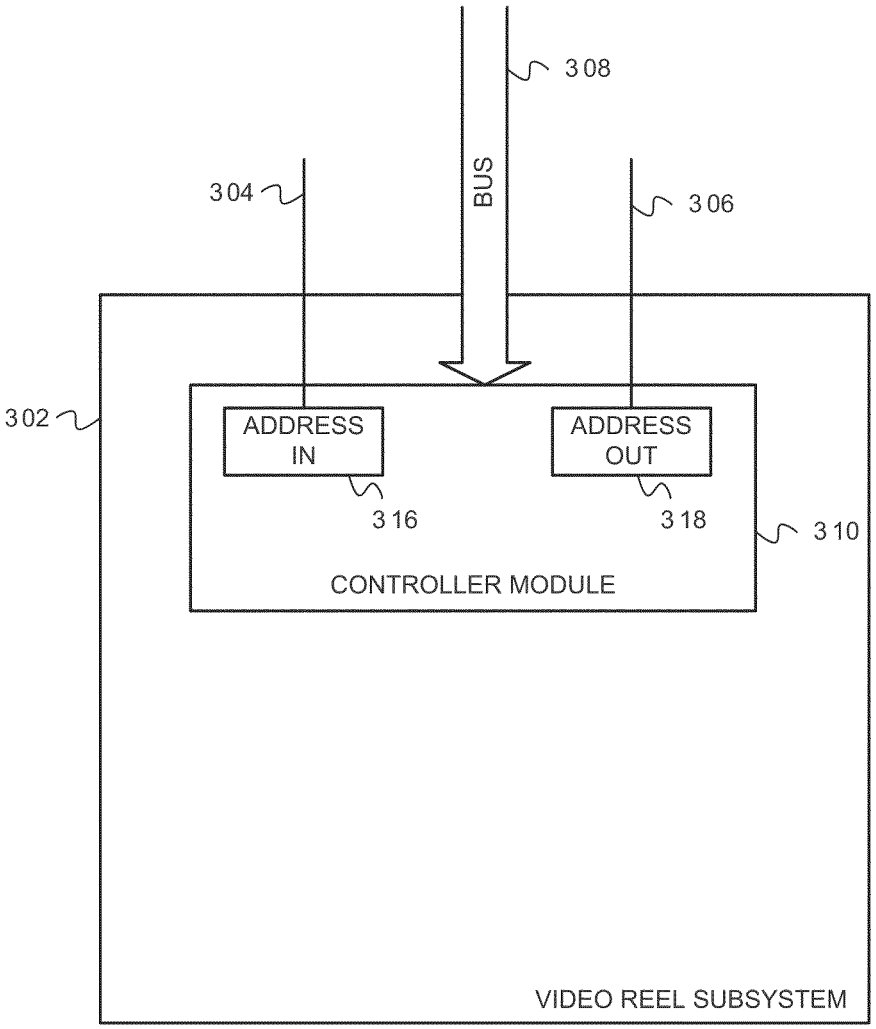
FIG. 3 is a block diagram illustrating the controller module in a video reel subsystem, according to some example embodiments.
Figure 4:
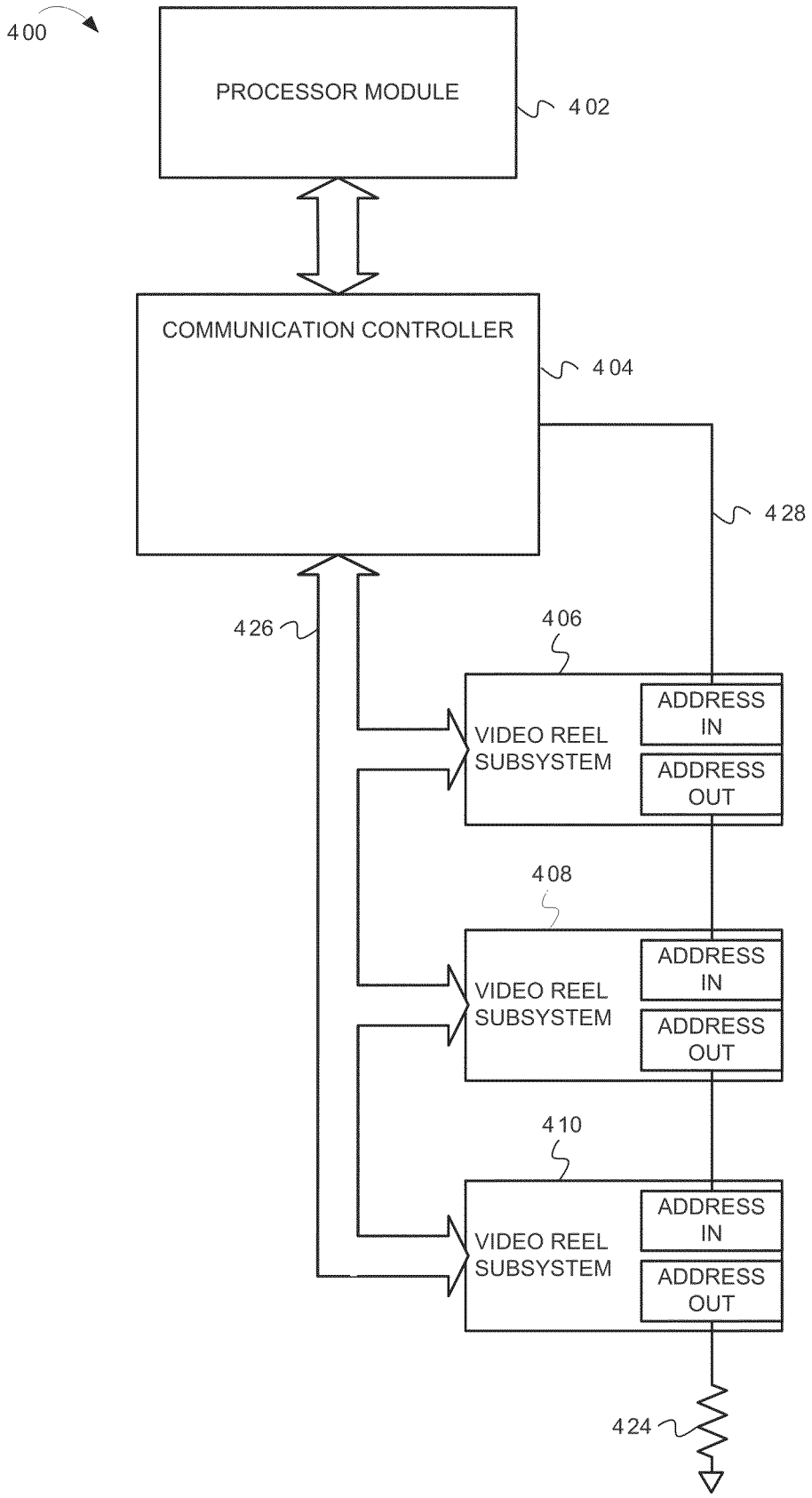
FIG. 4 is a block diagram illustrating a wagering game machine including a network for communications between a processor module and a number of video reel subsystems, according to some example embodiments.

In some example embodiments, the processor module 102 may be coupled to the video reel subsystems 104 using different types of smart peripheral networks (SPN). FIG. 3-4 include block diagrams for illustrating the process module 102 being coupled to the video reel subsystems 104 using an SPN that includes a communication controller that communicates with the video reel subsystems 104 that are in a daisy chain configuration.

FIG. 3 is a block diagram illustrating the controller module in a video reel subsystem, according to some example embodiments. In FIG. 3, the video reel subsystem 302 includes a controller module 310, which includes an address-in register 316 and an address-out register 318. The address-in register 316 can receive data over an address-in line 304, while the address-out register 318 can send data over an address-out line 306. The video reel subsystem 302 can use the address-in and address-out registers for dynamically acquiring communications addresses from a communication controller (not shown in FIG. 3). Also, the video reel subsystem 302 is coupled to receive data over a data bus 308 after acquisition of communications addresses. Operations for configuring video reel subsystem addresses are described below, in the next section.

This section continues with additional details about how a communication controller and video reel subsystems can work together in wagering game machines.

FIG. 4 is a block diagram illustrating a game machine including a network for communications between a processor module and a number of video reel subsystems, according to some example embodiments. In FIG. 4, the wagering game machine 400 includes a processor module 402, which represents any hardware and software for conducting wagering games and configuring and controlling video reels in the wagering game machine. The processor module 402 is connected to a communication controller 404, which is connected to video reel subsystems 406, 408, and 410 via a bus 426. Each video reel subsystem includes address-out and address-in registers for use when configuring communication addresses.

In FIG. 4, an address signal line 428 daisy chains the video reel subsystems 406, 408, and 410 to the communication controller 404. The address signal line 428 connects the last video reel subsystems of the daisy chain (i.e. peripheral device 410) to a resistor 424, which is connected to an electrical ground.

In some example embodiments, before the communication controller 404 assigns addresses, each video reel subsystem transmits a "do not respond" indicator to the address-in register of the device to which it is connected. The "do not respond" indicators (e.g., a data value, high signal, or other suitable signal) tell the video reel subsystems not to respond to communications on the bus 426. In some example embodiments, a video reel subsystem whose address-in register does not include a "do not respond" indicator can respond to communications on the bus 426 that are addressed to a "configuration address."

Consider the following example. The video reel subsystem 410 transmits a "do not respond" indicator to the video reel subsystem 408, which transmits a "do not respond" indicator to the video reel subsystem 406, which transmits the same to the communication controller 404. Because the video reel subsystem 410 is connected to the electrical ground, it is the only device that does not receive a "do not respond" indicator. Instead, it receives a "respond to configuration address" indicator (e.g., data value, a low signal, etc.). Thus, the video reel subsystem 410 can respond to communications addressed to a configuration address. The communication controller 404 then sends a new address in a communication addressed to the configuration address. In some example embodiments, after the video reel subsystem 410 receives a new address, it responds to the new address and does not respond to the configuration address. Also, after receiving a new address, the video reel subsystem 410 can send a "respond to configuration address" indicator to the video reel subsystem 408, telling the video reel subsystems 408 to respond to the configuration address. The process can be repeated until the communication controller 404 assigns all the video reel subsystems 406, 408, and 410 new addresses. At which point signal line 428 will carry a "respond to configuration address" indicator indicating to the communication controller 404 that all devices have been discovered.

After the communication controller 404 assigns new addresses to the video reel subsystems 406, 408, and 410, it can distribute content to those devices. The content may comprise one or more video sequences that are to be stored in a local machine-readable medium for subsequent display on a video reel. The content may also comprise instructions for a mechanical reel, which is converted to an address for a video sequence that corresponds to a stop result of the mechanical reel. In some example embodiments, at least some of such content may be downloaded from a game server over a network (as further described below). For example, different video sequences may be downloaded to correspond to different wagering games, updates to such games, etc. As further described below, in some example embodiments, the instructions for a mechanical reel are a result of execution of a game application.

In some example embodiments, the communication controller 404 can multicast and/or broadcast communications over the bus 426. In some example embodiments, the communication controller 404 sends broadcast communications to a broadcast address. For multicast communications, the communication controller 404 can address the communications to multiple addresses. The next section describes operations performed by these and other embodiments of the invention.

Figure 5:
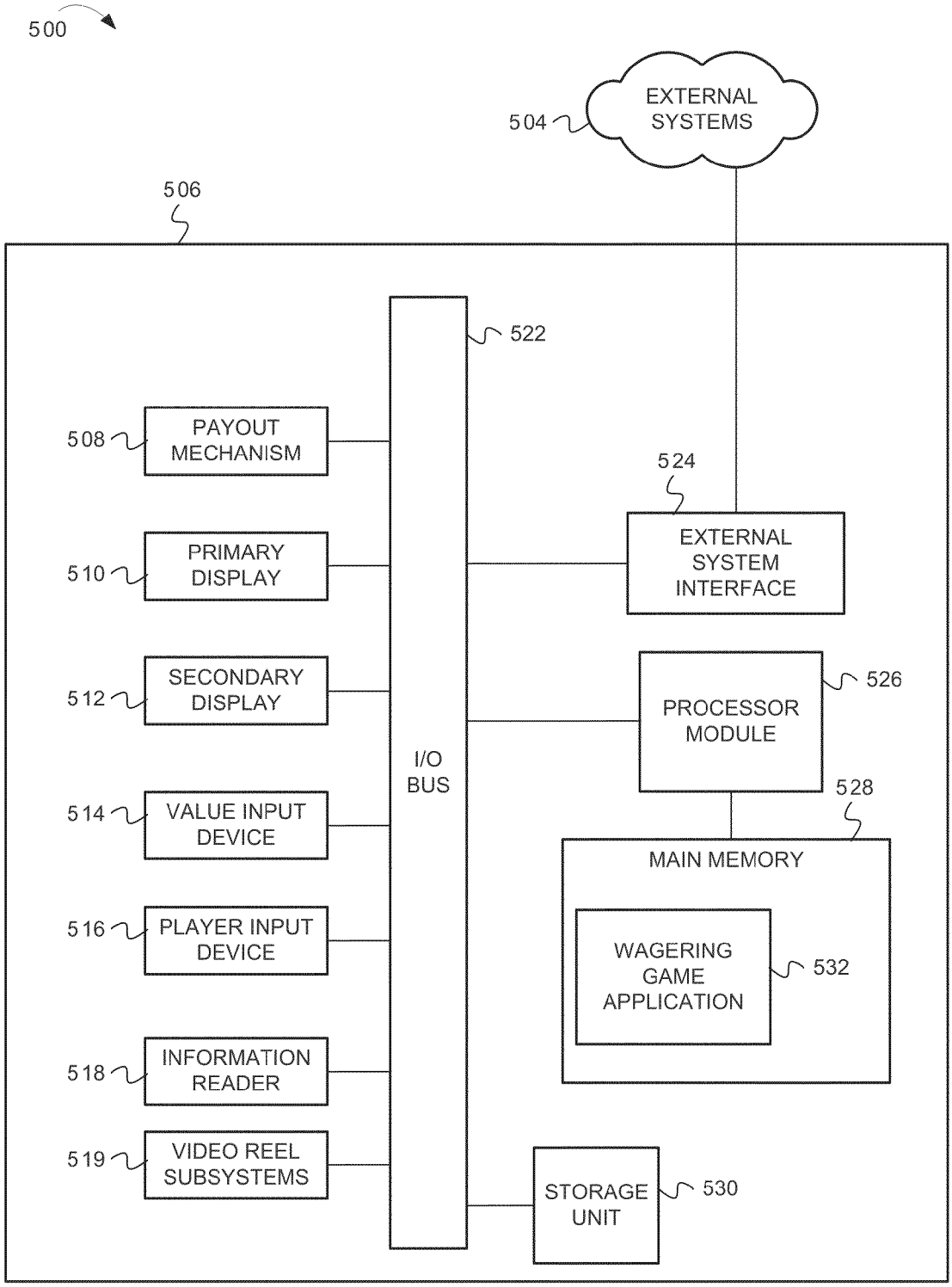
FIG. 5 is a block diagram illustrating a wagering game machine architecture, according to some example embodiments.

While FIGS. 2-4 show embodiments of a communication controller and video reel subsystems, FIG. 5 shows an example wagering game machine architecture.

FIG. 5 is a block diagram illustrating a wagering game machine architecture, according to some example embodiments. As shown in FIG. 5, the wagering game architecture 500 includes the wagering game machine 506 that includes a processor module 526 connected to main memory 528, which includes a wagering game application 532. In some example embodiments, the wagering game application 532 can present wagering games, such as video poker, video black jack, video slots, video lottery, etc., in whole or part.

The processor module 526 is also connected to an input/output (I/O) bus 522, which facilitates communication between the wagering game machine's components. The I/O bus 522 is connected to a payout mechanism 508, primary display 510, secondary display 512, value input device 514, player input device 516, information reader 518, video reel subsystems 519 and storage unit 530. The player input device 516 can include the value input device 514 to the extent the player input device 516 is used to place wagers. The video reel subsystems 519 may be coupled to the I/O bus 522 with or without other devices there between. In some example embodiments, the video reel subsystems 519 may be coupled to the I/O bus 522 through any type of device, network, etc. For example, the video reel subsystems 519 may be coupled to a communication controller (as described above). The I/O bus 522 is also connected to an external system interface 524, which is connected to external systems 504 (e.g., wagering game networks).

In some example embodiments, the wagering game machine 506 can include additional peripheral devices and/or more than one of each component shown in FIG. 5. For example, in some example embodiments, the wagering game machine 506 can include multiple external system interfaces 524 and multiple processor modules 526. In some example embodiments, any of the components can be integrated or subdivided. Additionally, in some example embodiments, the components of the wagering game machine 506 can be interconnected according to any suitable interconnection architecture (e.g., directly connected, hypercube, etc.).

In some example embodiments, any of the components of the wagering game machine 506 can include hardware, firmware, and/or software for performing the operations described herein. Machine-readable media includes any mechanism that provides (e.g., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Operations

This section describes operations performed by some example embodiments. In the discussion below, the method is described with reference to the block diagrams presented above. In certain embodiments, the operations are performed by instructions residing on machine-readable media (e.g., software), while in other embodiments, the operations are performed by hardware and/or other logic (e.g., firmware). In some embodiments the operations are performed in series, while in other embodiments, the operations can be performed in parallel.

Figure 6:
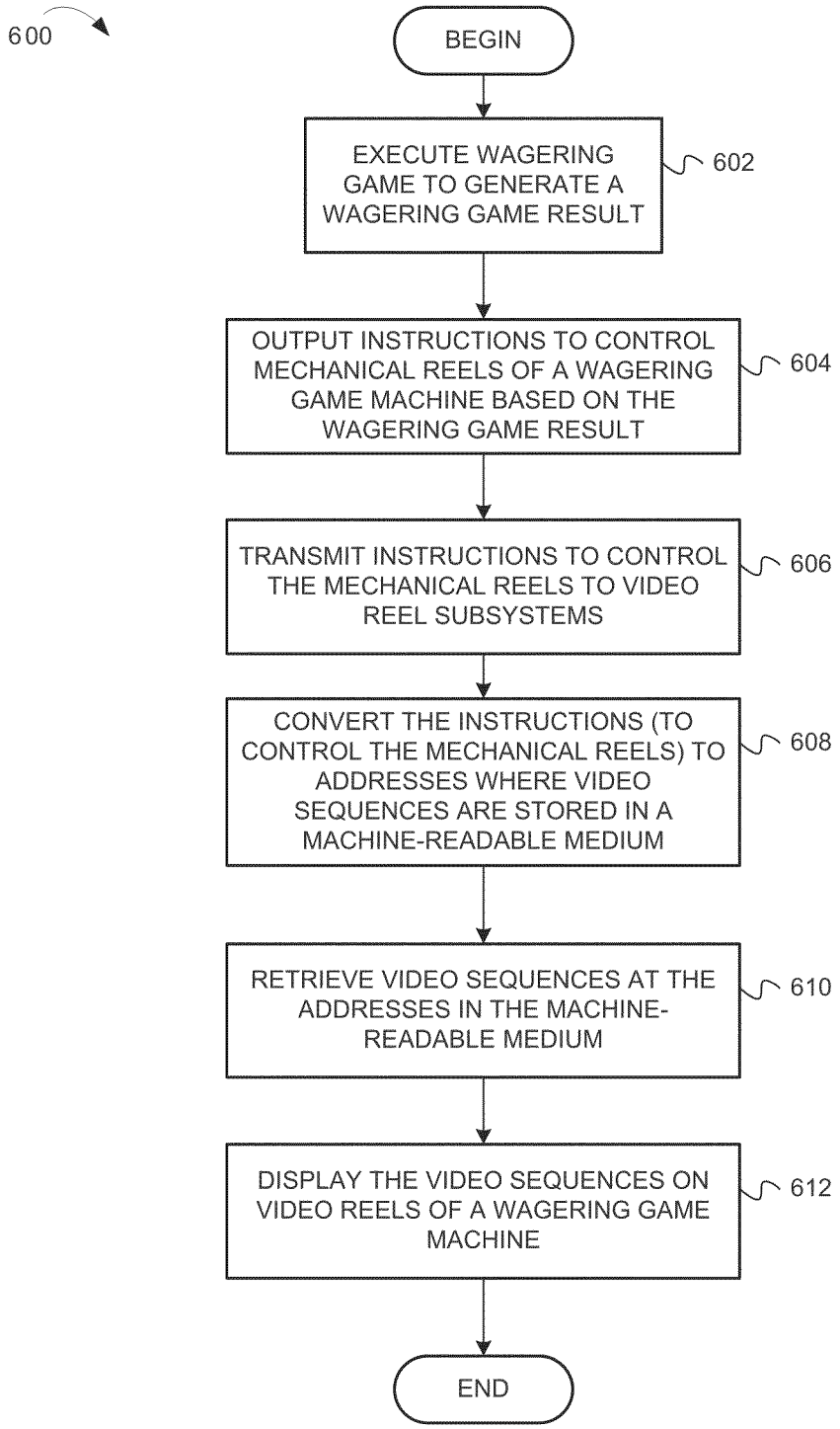
FIG. 6 is a method illustrating operations for controlling video reels in a wagering game machine, according to some example embodiments.

FIG. 6 is a method illustrating operations for controlling video reels in a game machine, according to some example embodiments. A method 600 begins at block 602.

At block 602, a wagering game is executed to generate a wagering game result. For example, the processor module 102 (see. FIG. 1) may execute a wagering game application. Alternatively or in addition, components external to the game machine may execute the wagering game application or determine a result for a wagering game. For example, as described in more detail below, the wagering game machine may be coupled to a network. Accordingly, the wagering game application may be executed by a different component coupled to the network (e.g., a game server). Alternatively, a central determinant system may determine a result for a wagering game. In either case, the result could then be downloaded to the wagering game machine. The method continues at block 604.

At block 604, instructions to control mechanical reels of a wagering game machine are output based on the wagering game result. For example, the processor module 102 (see FIG. 1) may output these instructions. The instructions may be for one to N number of mechanical reels (e.g., three, five, seven, etc.). For a given mechanical reel, the mechanical reel instructions 106 may comprise an instruction to spin for a time period, locate a home position on the mechanical reel, proceed N number of motor steps and then stop. The instructions may also comprise synchronization among the mechanical reels. For example, mechanical reel A stops at time point X; mechanical reel B stops at time point X+N, mechanical reel C stops at time point X+N+M, etc. The method continues at block 606.

At block 606, the instructions to control the mechanical reels are transmitted to the video reel subsystems. For example, the processor module 102 (see FIG. 1) may transmit these instructions to the video reel subsystems 104. In some example embodiments, the instructions may be transmitted through a SPN (such as the one shown in FIG. 4 above). Alternatively, the processor module 102 may be directly coupled to the video reel subsystems 104. Thus, the processor module 102 may transmit the instructions directly to the video reel subsystems 104. In some example embodiments, the processor module 102 may separate the instructions based on the mechanical reels. For example, the instructions for mechanical reel A are to be transmitted to the video reel subsystem 104 that is to display the video on the associated video reel; the instructions for mechanical reel B are to be transmitted to the video reel subsystem 104 that is to display the video on the associated video reel; etc. In such embodiments, only the instructions for the associated mechanical reel are transmitted to a given video reel subsystem. With reference to FIG. 4, the communication controller 404 may transmit the instructions for a given mechanical reel to the associated video reel subsystem 406-410 based on their assigned addresses using the bus 426 (as described above). For example, the processor module 402 may transmit the instructions for mechanical reel A to the communication controller 404. The communication controller 404 may then determine which video reel subsystem is associated with mechanical reel A (assume video reel subsystem 406). The communication controller 404 may then transmit these instructions to the video reel subsystem 406 based on its assigned address. Similar operations may be performed for each of the video reels. The method continues at block 608.

At block 608, the instructions (to control the mechanical reels) are converted to addresses where the video sequences are stored in a machine-readable medium. For example, the controller module 202 in a video reel subsystem (see FIG. 2) may convert the mechanical reel instructions to addresses of video sequences. These video sequences may be a display of a spinning reel or a display of a stop result of the reel (as described above). In some example embodiments, this conversion is performed in each of the different video reel subsystems. The method continues at block 610.

At block 610, the video sequences are retrieved at the addresses in the machine-readable medium. For example, the controller module 202 in a video reel subsystem (see FIG. 2) may retrieve the video sequences 208 from the machine-readable medium 204. The method continues at block 612.

At block 612, the video sequences are displayed on the video reels of a wagering game machine. For example, the controller module 202 in a video reel subsystem (see FIG. 2) may cause the video reel display device 210 to display the retrieved video sequence 212 on a video reel of the wagering game device. In some example embodiments, the video reel display device 210 displays a video sequence of a spinning reel for a time period (as defined in the mechanical reel instructions). The video reel display device 210 then displays a video sequence of a stop result (that is a conversion of a stop result for a mechanical reel, as described above). The method 600 is complete.

The method 600 is described such that the video sequences are stored in machine-readable media in the video reel subsystems and the conversion to a video sequence occurs in these subsystems. In other embodiments, the video sequences may be stored in a machine-readable medium coupled to the processor module 102. Moreover, the processor module 102 may convert the mechanical reel instructions to addresses of video sequences. Accordingly, the addresses of video sequences or the video sequences themselves may be transmitted to the video reel subsystems. In other embodiments, the storage of the video sequences and/or the conversion may be external to the wagering game machine. For example, this storage and/or conversion may be in a component coupled to a network to which the wagering game device is coupled (e.g., a game server) (see description of FIG. 7).

Example Wagering Game Network

Figure 7:
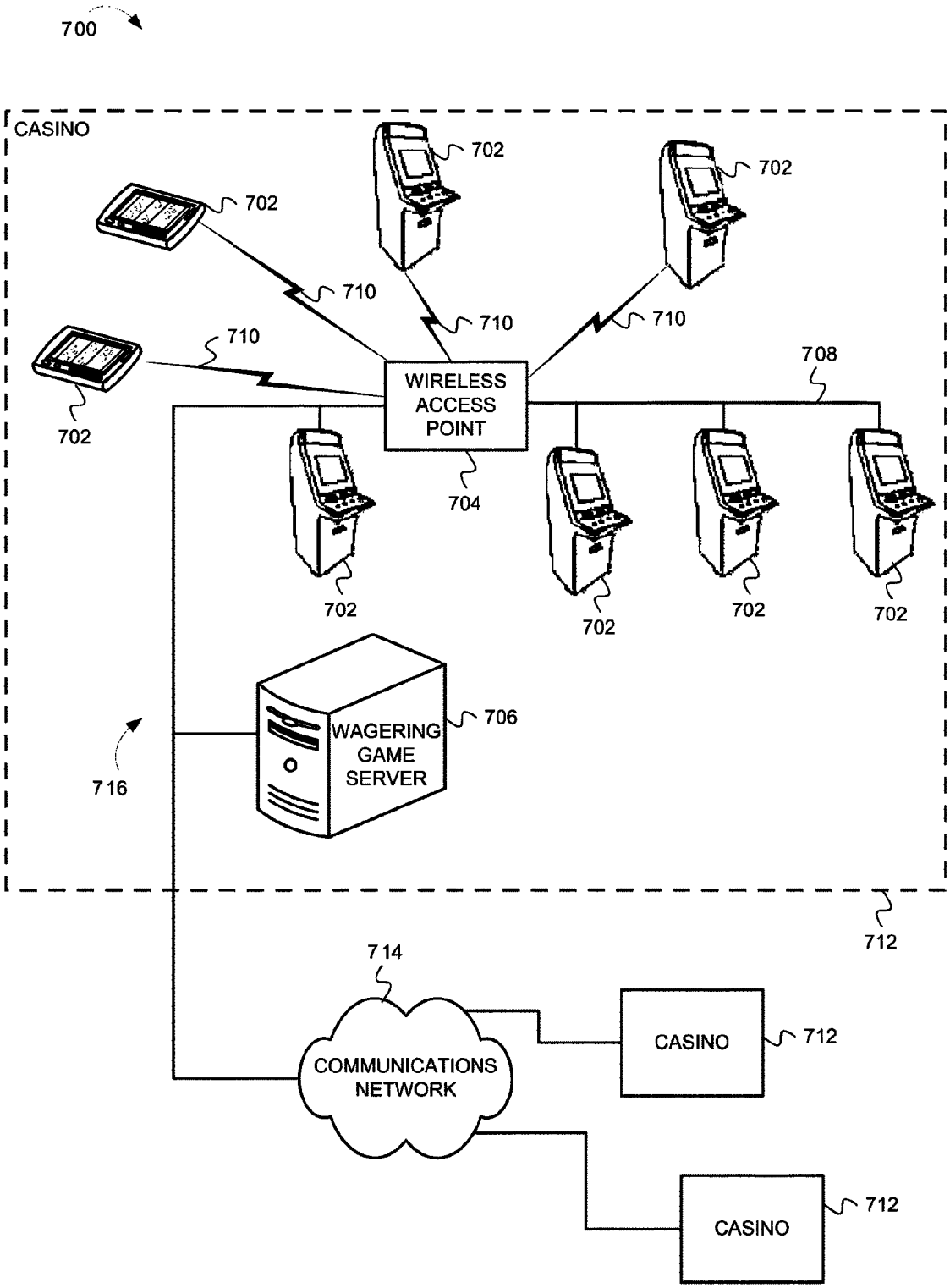
FIG. 7 is a block diagram illustrating a wagering game network, according to some example embodiments.

As described above, some content (including the video sequences used for the video reels in the game machine) may be downloaded from devices coupled to a network. FIG. 7 is a block diagram illustrating a wagering game network, according to some example embodiments. As shown in FIG. 7, a wagering game network 700 includes a plurality of casinos 712 connected to a communications network 714.

Each of the plurality of casinos 712 includes a local area network 716, which may include a wireless access point 704, wagering game machines 702, and a wagering game server 706 that can serve wagering games over the local area network 716. As such, the local area network 716 includes wireless communication links 710 and wired communication links 708. The wired and wireless communication links can employ any suitable connection technology, such as Bluetooth, 802.11, Ethernet, public switched telephone networks, SONET, etc. In one embodiment, the wagering game server 706 can serve wagering games and/or distribute content to devices located in other casinos 712 or at other locations on the communications network 714.

The wagering game machines 702 and wagering game server 706 can include hardware and machine-readable media including instructions for performing the operations described herein.

The wagering game machines 702 described herein can take any suitable form, such as floor standing models, handheld mobile units, bartop models, workstation-type console models, etc. Further, the wagering game machines 702 can be primarily dedicated for use in conducting wagering games, or can include non-dedicated devices, such as mobile phones, personal digital assistants, personal computers, etc. In one embodiment, the wagering game network 700 can include other network devices, such as accounting servers, wide area progressive servers, player tracking servers, and/or other devices suitable for use in connection with embodiments of the invention.

In various embodiments, wagering game machines 702 and wagering game servers 706 work together such that a wagering game machine 702 may be operated as a thin, thick, or intermediate client. For example, one or more elements of game play may be controlled by the wagering game machine 702 (client) or the wagering game server 706 (server). Game play elements may include executable game code, lookup tables, configuration files, game outcome, audio or visual representations of the game, game assets or the like. In a thin-client example, the wagering game server 706 may perform functions such as determining game outcome or managing assets, while the wagering game machine 702 may be used merely to present the graphical representation of such outcome or asset modification to the user (e.g., player). In a thick-client example, game outcome may be determined locally (e.g., at the wagering game machine 702) and then communicated to the wagering game server 706 for recording or managing a player's account.

Similarly, functionality not directly related to game play may be controlled by the wagering game machine 702 (client) or the wagering game server 706 (server) in embodiments. For example, power conservation controls that manage a display screen's light intensity may be managed centrally (e.g., by the wagering game server 706) or locally (e.g., by the wagering game machine 702). Other functionality not directly related to game play may include presentation of advertising, software or firmware updates, system quality or security checks, etc.

Example Wagering Game Machines

Example Wagering Game Machine

Figure 8:
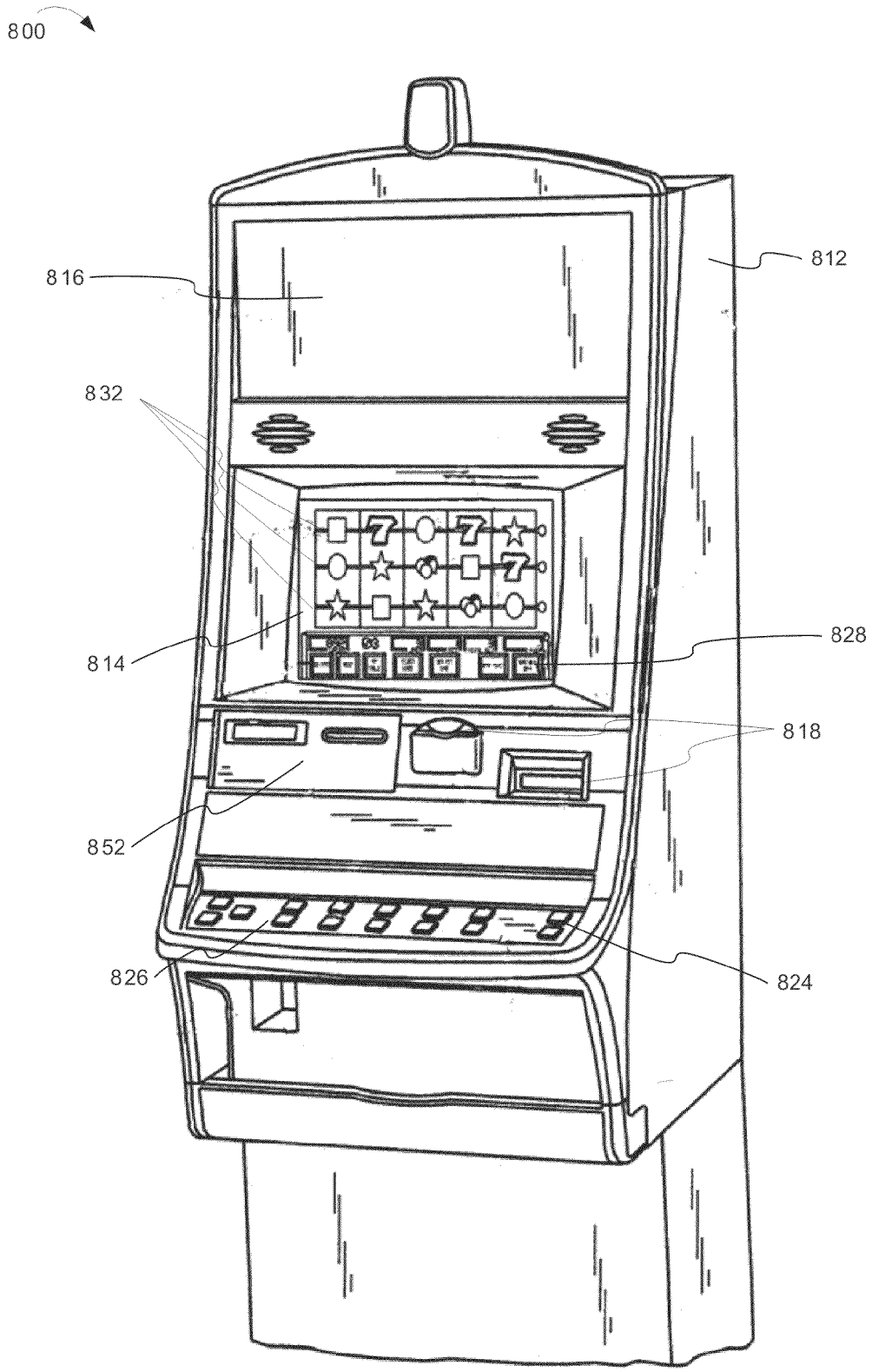
FIG. 8 is a perspective view of a wagering game machine, according to some example embodiments.

FIG. 8 is a perspective view of a wagering game machine, according to some example embodiments. Referring to FIG. 8, a wagering game machine 800 is used in gaming establishments, such as casinos. According to embodiments, the wagering game machine 800 can be any type of wagering game machine and can have varying structures and methods of operation. For example, the wagering game machine 800 can be an electromechanical wagering game machine configured to play mechanical slots, or it can be an electronic wagering game machine configured to play video casino games, such as blackjack, slots, keno, poker, blackjack, roulette, etc.

The wagering game machine 800 comprises a housing 812 and includes input devices, including value input devices 818 and a player input device 824. For output, the wagering game machine 800 includes a primary display 814 for displaying information about a basic wagering game. The primary display 814 can also display information about a bonus wagering game and a progressive wagering game. The wagering game machine 800 also includes a secondary display 816 for displaying wagering game events, wagering game outcomes, and/or signage information. While some components of the wagering game machine 800 are described herein, numerous other elements can exist and can be used in any number or combination to create varying forms of the wagering game machine 800.

The value input devices 818 can take any suitable form and can be located on the front of the housing 812. The value input devices 818 can receive currency and/or credits inserted by a player. The value input devices 818 can include coin acceptors for receiving coin currency and bill acceptors for receiving paper currency. Furthermore, the value input devices 818 can include ticket readers or barcode scanners for reading information stored on vouchers, cards, or other tangible portable storage devices. The vouchers or cards can authorize access to central accounts, which can transfer money to the wagering game machine 800.

The player input device 824 comprises a plurality of push buttons on a button panel 826 for operating the wagering game machine 800. In addition, or alternatively, the player input device 824 can comprise a touch screen 828 mounted over the primary display 814 and/or secondary display 816.

The various components of the wagering game machine 800 can be connected directly to, or contained within, the housing 812. Alternatively, some of the wagering game machine's components can be located outside of the housing 812, while being communicatively coupled with the wagering game machine 800 using any suitable wired or wireless communication technology.

The operation of the basic wagering game can be displayed to the player on the primary display 814. The primary display 814 can also display a bonus game associated with the basic wagering game. The primary display 814 can include a cathode ray tube (CRT), a high resolution liquid crystal display (LCD), a plasma display, light emitting diodes (LEDs), or any other type of display suitable for use in the wagering game machine 800. In FIG. 8, the wagering game machine 800 is an "upright" version in which the primary display 814 is oriented vertically relative to the player. Alternatively, the wagering game machine can be a "slant-top" version in which the primary display 814 is slanted at about a thirty-degree angle toward the player of the wagering game machine 800. In yet another embodiment, the wagering game machine 800 can exhibit any suitable form factor, such as a free standing model, bartop model, mobile handheld model, or workstation console model.

A player begins playing a basic wagering game by making a wager via the value input device 818. The player can initiate play by using the player input device's buttons or touch screen 828. The basic game can include arranging a plurality of symbols along a payline 832, which indicates one or more outcomes of the basic game. Such outcomes can be randomly selected in response to player input. At least one of the outcomes, which can include any variation or combination of symbols, can trigger a bonus game.

In some embodiments, the wagering game machine 800 can also include an information reader 852, which can include a card reader, ticket reader, bar code scanner, RFID transceiver, or computer readable storage medium interface. In some embodiments, the information reader 852 can be used to award complimentary services, restore game assets, track player habits, etc.

General

In this detailed description, reference is made to specific examples by way of drawings and illustrations. These examples are described in sufficient detail to enable those skilled in the art to practice the inventive subject matter, and serve to illustrate how the inventive subject matter can be applied to various purposes or embodiments. Other embodiments are included within the inventive subject matter, as logical, mechanical, electrical, and other changes can be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims.

Each of the embodiments described herein are contemplated as falling within the inventive subject matter, which is set forth in the following claims.

What is claimed is:

1. A gaming machine configured to present a wagering game including a randomly selected game outcome, the gaming machine comprising:

one or more input devices;

one or more video display devices;

one or more processors; and one or more memory devices, at least one of the one or more memory devices storing instructions that, when executed by at least one of the one or more processors, cause the gaming machine to:

receive an input from a player indicative of a wager to initiate the wagering game;

receive, into at least one of the one or more memory devices, mechanical reel instructions for positioning at least one of a plurality of mechanical reels so that the plurality of mechanical reels will display the randomly selected game outcome as an array of reel symbols;

convert the mechanical reel instructions into one or more identifiers corresponding to respective video sequences of a plurality of video sequences stored on at least one of the one or more memory devices, the plurality of video sequences including at least one video representation of a reel symbol; and display the corresponding video sequences identified by the one or more identifiers to provide a video representation of the plurality of mechanical reels displaying the randomly selected game outcome.

2. The gaining machine of claim 1, wherein the mechanical reel instructions include spinning one or more of the plurality of mechanical reels for a designated time period and stopping at a stop result showing one or more reel symbols.

3. The gaming machine of claim 2, wherein the plurality of video sequences further includes video representations of the stop result and at least part of a spinning reel.

4. The gaming machine of claim 1, wherein the video sequences of the plurality of video sequences can depict every game outcome that can be selected from reel symbols on the plurality of mechanical reels.

5. The gaming machine of claim 1, wherein the at least one of the one or more processors of the gaming machine executes the wagering game and generates the mechanical reel instructions.

6. The gaming machine of claim 1, wherein the mechanical reel instructions are generated by the wagering game executing on a game server residing on a communications network, and wherein the game server transmits the mechanical reel instructions to the gaming machine via the communications network.

7. The gaming machine of claim 1, wherein the one or more identifiers are addresses in the one or more memory devices at which the corresponding video sequences are stored.

8. The gaming machine of claim 1, wherein the gaming machine further includes a plurality of video subsystems corresponding one-to-one to the plurality of mechanical reels, each of the video subsystems including at least one subsystem processor, at least one video sequence storage device storing one or more video sequences of the plurality of video sequences, and at least one video reel display device for displaying video sequences, and wherein the converting, the retrieving, and the displaying associated with each mechanical reel of the plurality of mechanical reels are performed by the corresponding video subsystem of the plurality of video subsystems.

9. A computer-implemented method of presenting a wagering game on a gaming machine, the wagering game including randomly selecting a wagering game outcome, the gaming machine including one or more input devices, one or more video display devices, one or more memory devices, and one or more processors, the method comprising:

receiving, via at least one of the one or more input devices, an input from a player indicative of a wager initiating the wagering game;

receiving, into at least one of the one or more memory devices, mechanical reel instructions for positioning at least one of a plurality of mechanical reels so that the plurality of mechanical reels will display the randomly selected game outcome as an array of reel symbols;

converting, via at least one of the one or more processors, the mechanical reel instructions into one or more identifiers corresponding to respective video sequences of a plurality of video sequences stored on at least one of the one or more memory devices, the plurality of video sequences including at least one video representation of a reel symbol;

displaying, on at least one of the one or more video display devices, the corresponding video sequences identified to the one or more identifiers to provide a video representation of the plurality of mechanical reels displaying the selected game outcome.

10. The computer-implemented method of claim 9, wherein the mechanical reel instructions include spinning one or more of the plurality of mechanical reels for a designated time period and stopping at a stop result showing one or more reel symbols.

11. The computer-implemented method of claim 10, wherein the plurality of video sequences further includes video representations of the stop result and at least part of a spinning reel.

12. The computer-implemented method of claim 9, wherein the video sequences of the plurality of video sequences can depict every game outcome that can be selected from reel symbols on the plurality of mechanical reels.

13. The computer-implemented method of claim 9, wherein the gaming machine executes the wagering game and generates the mechanical reel instructions via at least one of the one or more processors.

14. The computer-implemented method of claim 9, wherein the mechanical reel instructions are generated by the wagering game executing on a game server residing on a communications network, and wherein the game server transmits the mechanical reel instructions to the at least one memory device via the communications network.

15. A gaming system configured to display video reels in response to mechanical reel instructions for displaying a randomly selected game outcome of a wagering game, the gaming system comprising:

one or more input devices;

one or more video display devices;

one or more processors; and one or more memory devices, at least one of the one or more memory devices storing instructions that, when executed by at least one of the one or more processors, cause the gaming system to:

receive an input from a player indicative of a wager initiating a wagering game;

receive mechanical reel instructions for positioning at least one of a plurality of mechanical reels so that the plurality of mechanical reels will display the randomly selected game outcome as an array of symbols;

convert the mechanical reel instructions into one or more identifiers corresponding to respective video sequences of the plurality of video sequences stored on at least one of the one or more memory devices, the plurality of video sequences including at least one video representation of a reel symbol; and display, on the one or more video display devices, the corresponding video sequences identified by the one or more identifiers to provide a video representation of the plurality of mechanical reels displaying the selected game outcome.

16. The gaming system of claim 15, wherein the mechanical reel instructions include one or more of an instruction to spin a mechanical reel for a time period, locate a home position on the mechanical reel, proceed N number of motor steps, and stop the mechanical reel.

17. The gaming system of claim 16, wherein the plurality of video sequences further includes one or more video sequences depicting at least part of a spinning mechanical reel.

18. The gaming system of claim 15, wherein the video sequences of the plurality of video sequences can depict every game outcome that can be selected from reel symbols on the plurality of mechanical reels.

19. The gaming system of claim 15, wherein the mechanical reel instructions are generated by a game server residing on a communications network, and wherein the game server transmits the mechanical reel instructions to the gaming system via the communications network.

20. The gaming system of claim 19, wherein the one or more identifiers are addresses in the one or more memory devices at which the corresponding video sequences are stored.

21. A gaming machine configured to display video reels in response to mechanical reel instructions for displaying a randomly selected wagering game outcome, the gaming machine comprising:

a plurality of video subsystems, each video subsystem of the plurality of subsystems including at least one subsystem processor, at least one subsystem memory device, and at least one video reel display device;

one or more input devices;

one or more primary processors; and one or more primary memory devices storing instructions that, when executed by at least one of the one or more primary processors, cause the gaming machine to:

receive an input from a player indicative of a wager to initiate a wagering game;

randomly select a wagering game outcome for display as an array of reel symbols on a plurality of mechanical reels, the reels of the plurality of mechanical reels corresponding one-to-one to the subsystems of the plurality of video subsystems;

generate, via at least one of the one or more primary processors, mechanical reel instructions for positioning at least one of the plurality of mechanical reels so that the plurality of mechanical reels will display the selected game outcome;

convert, via at least one of the subsystem processors, the mechanical reel instructions into one or more identifiers corresponding to respective video sequences of the plurality of video sequences stored in at least one of the video storage devices, the plurality of video sequences including at least one video representation of a reel symbol;

display, via at least one of the video reel display devices, the corresponding video sequences identified by the one or more identifiers to provide a video representation of the plurality of mechanical reels displaying the selected game outcome.

22. The gaming machine of claim 21, wherein the mechanical reel instructions include spinning one or more of the plurality of mechanical reels for a designated time period, locating a home position on the one or more mechanical reels, proceed N number of motor steps, and stop the one or more mechanical reels.

23. The gaming machine of claim 22, wherein the plurality of video sequences further includes one or more video sequences depicting at least part of a spinning mechanical reel.

24. The gaming machine of claim 21, wherein the video sequences of the pluralities of video sequences can depict every game outcome that can be selected from reel symbols on the plurality of mechanical reels.

25. The gaming machine of claim 21, wherein the mechanical reel instructions are transmitted from the at least one primary processor to the plurality of video subsystems via one or more data ports that are not video output ports.

* * * * *

UNITED STATES PATENT AND TRADEMARK OFFICE

CERTIFICATE OF CORRECTION

PATENT NO. : 8,591,328 B2
APPLICATION NO. : 12/480202
DATED : November 26, 2013
INVENTOR(S) : James M. Rasmussen It is certified that error appears in the above-identified patent and that said Letters Patent is hereby corrected as shown below:

In the Claims

On Column 12, Line 38 (Claim 2, Line 1), please delete “gaining” and insert -- gaming --, therefor.

On Column 13, Line 29 (Claim 9, Line 23), please delete “to” and insert -- by --, therefor.

Signed and Sealed this
Second Day of December, 2014

Michelle K. Lee

Michelle K. Lee
*Deputy Director of the United States Patent and Trademark Office*